US009410546B2

(12) United States Patent
Jaeger et al.

(10) Patent No.: US 9,410,546 B2
(45) Date of Patent: Aug. 9, 2016

(54) RECIPROCATING PUMP CAVITATION DETECTION AND AVOIDANCE

(71) Applicant: Baker Hughes Incorporated, Houston, TX (US)

(72) Inventors: Thomas Jaeger, The Woodlands, TX (US); Ashley Christian, Houston, TX (US); Gregory E. Griffith, Spring, TX (US); Gulshan Singh, The Woodlands, TX (US); Michael Lataquin, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 186 days.

(21) Appl. No.: 14/458,068

(22) Filed: Aug. 12, 2014

(65) Prior Publication Data

US 2016/0047373 A1 Feb. 18, 2016

(51) Int. Cl.
*F04B 51/00* (2006.01)
*F04B 49/06* (2006.01)

(52) U.S. Cl.
CPC ..... *F04B 51/00* (2013.01); *F04B 49/065* (2013.01)

(58) Field of Classification Search
None
See application file for complete search history.

(56) References Cited

U.S. PATENT DOCUMENTS

| | | | | |
|---|---|---|---|---|
| 5,720,598 | A | 2/1998 | de Chizzele | |
| 6,882,960 | B2 * | 4/2005 | Miller | F04B 51/00 702/177 |
| 7,013,223 | B1 | 3/2006 | Zhang et al. | |
| 7,401,500 | B2 | 7/2008 | Wago et al. | |
| 7,621,179 | B2 | 11/2009 | Ens et al. | |
| 7,643,945 | B2 | 1/2010 | Baklanov et al. | |
| 7,757,562 | B2 | 7/2010 | Mercer | |
| 8,366,402 | B2 * | 2/2013 | St. Michel | E21B 47/0008 417/53 |
| 8,543,245 | B2 | 9/2013 | Heitman et al. | |
| 8,554,494 | B2 | 10/2013 | Adnan et al. | |
| 2002/0123856 | A1 * | 9/2002 | Eryurek | G05B 23/0243 702/140 |
| 2004/0112115 | A1 | 6/2004 | Ramamoorthy et al. | |
| 2004/0167738 | A1 * | 8/2004 | Miller | F04B 51/00 702/114 |
| 2005/0126639 | A1 | 6/2005 | Ens et al. | |
| 2005/0180868 | A1 * | 8/2005 | Miller | F04B 51/00 417/437 |
| 2006/0228225 | A1 | 10/2006 | Rogers | |
| 2008/0006089 | A1 | 1/2008 | Adnan et al. | |
| 2009/0043530 | A1 * | 2/2009 | Sittler | G01M 13/028 702/141 |
| 2010/0300683 | A1 | 12/2010 | Looper et al. | |
| 2013/0259707 | A1 * | 10/2013 | Yin | F04B 49/00 417/53 |

* cited by examiner

*Primary Examiner* — Andre Allen
(74) *Attorney, Agent, or Firm* — Shawn Hunter

(57) ABSTRACT

Systems and methods for detecting cavitation in a reciprocating positive displacement pump. Fluid pressure proximate the pump's suction manifold is compared to a predetermined pressure that would be conducive to cavitation. If the detected pressure approximates the predetermined pressure, the presence of cavitation is confirmed via correlation of increased vibration.

15 Claims, 8 Drawing Sheets

RECIPROCATING PUMP CAVITATION DETECTION AND AVOIDANCE

BACKGROUND OF THE INVENTION

1. Field of the Invention

The invention relates generally to reciprocating pumps. In particular aspects, the invention relates to systems and methods for detecting and monitoring abnormal conditions within a pump, including cavitation.

2. Description of the Related Art

Reciprocating positive displacement pumps used in the well service industry and drilling mud pump industry are exposed to high pressure, high flow rate and abrasive fluids (slurry) for the purpose of fracturing, drilling and so forth. Reciprocating pumps can be single or double acting pumps with pistons that are driven by a crankshaft that is actuated by a motor. Reciprocating positive displacement pumps have at least one piston cylinder, but often have multiple cylinders, such as three-cylinder (triplex) and five-cylinder (quintuplex) configurations.

Cavitation affects reciprocating pumps during operation. Cavitation occurs when actual pressure reaches the vapor pressure of the fluid being pumped, and the fluid starts to vaporize. Small vapor bubbles are formed and, under compression, will implode. If these implosions occur in close proximity to the pump housings or valve surfaces, they will start to impinge the material, causing material to be removed and damaged. Cavitation can cause permanent damage and, if not prevented in time, can lead to complete destruction of the pump housing and/or associated components.

Efforts have been made to identify cavitation in an operating pump using acoustic signal analysis. However, this has proven problematic. There is a wide variety of vibration or acoustic signal responses that relate to a variety of abnormal conditions, which makes it difficult to differentiate between cavitation, valve wear, seal failure, or other conditions.

SUMMARY OF THE INVENTION

The invention provides systems and methods for detection of cavitation within a reciprocating pump. In certain aspects, the systems and methods of the present invention permit detection of cavitation with particularity so that other abnormal conditions may be excluded.

In a described embodiment, a sensor is used to detect fluid pressure within or proximate the suction or intake manifold of the pump. An accelerometer is disposed on the fluid end cylinder housing of the pump for detection of vibration. A timing marker is operably associated with a plunger of the pump and detect the speed of operation of the pump.

Actual fluid pressure detected at or near the suction manifold is compared to a predetermined pressure which would be conducive to cavitation. In particular embodiments, the predetermined pressure is the vapor pressure for the fluid being pumped by the pump 10.

The accelerometer is monitored to detect an increase is vibration or shocks. An increase in vibration/shocks is correlated with the condition of the measured pressure approximating the predetermined pressure. This correlation indicates cavitation.

In accordance with currently preferred embodiments, a data processor receives data signals from the pressure sensor, accelerometer and timing marker which are indicative of the parameters being sensed by those components. The data processor then compares the detected pressure with a predetermined pressure (i.e., vapor pressure) and checks for cavitation. If the processor determines that cavitation is occurring, it can then take one or more actions in response. These actions include providing a message to an operator and automated adjustment of pump parameters to attempt to correct the cavitation.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
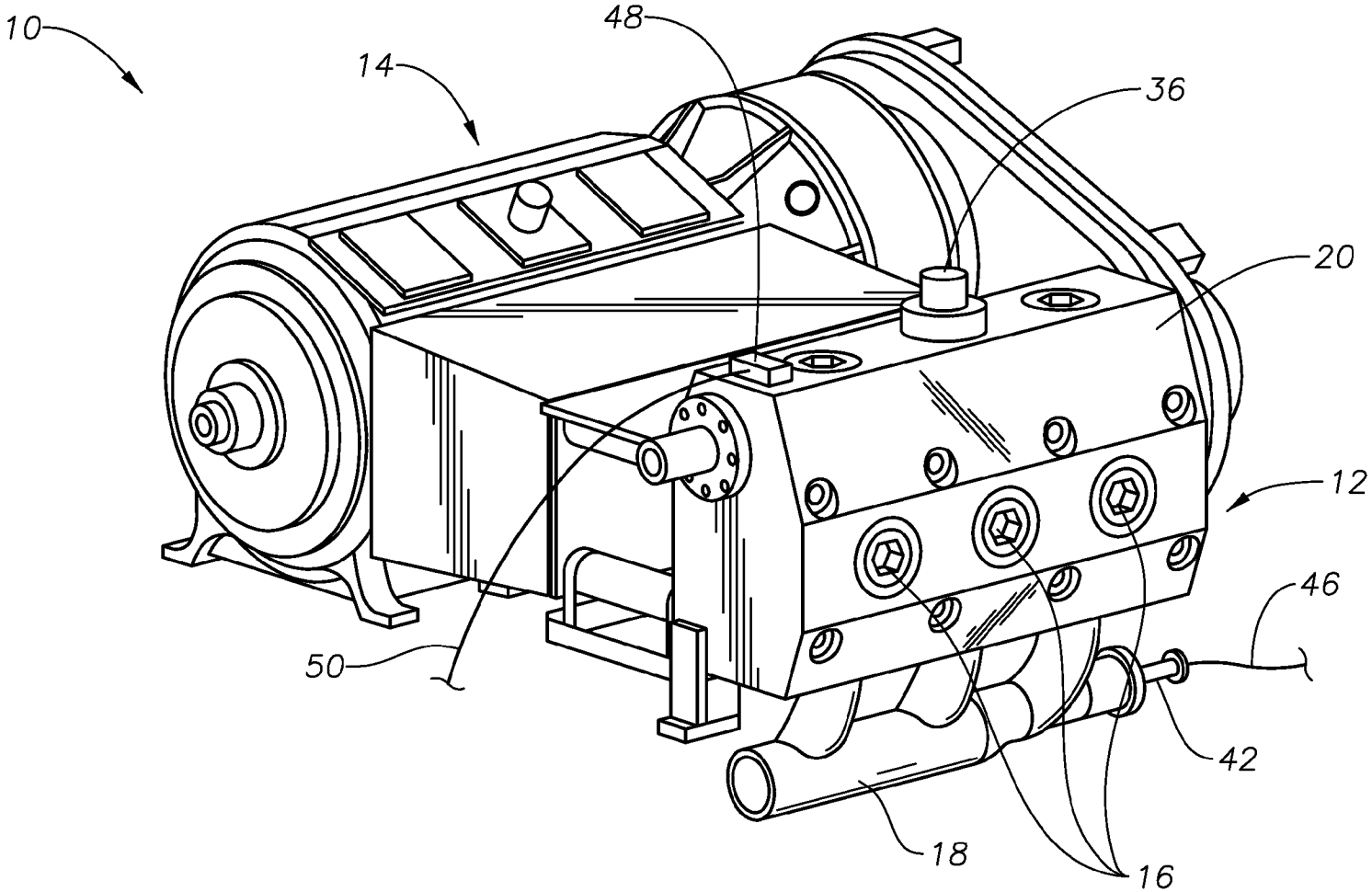
FIG. 1 is an external, isometric view of an exemplary reciprocating pump having a cavitation detection system in accordance with the present invention.

FIGS. 1-4 illustrate an exemplary reciprocating pump 10 which broadly includes a fluid end 12, which draws fluid into the pump 10 and expels it, and a power end 14, which receives power from an associated motor or other prime mover and transmits this power to the fluid end 12. In the depicted embodiment, the pump 10 is a triplex pump having three pistons, which are evidenced by the cylinder heads 16 in FIGS. 1-2. A suction manifold 18 leads into the fluid end 12 of the pump 10.

Figure 3:
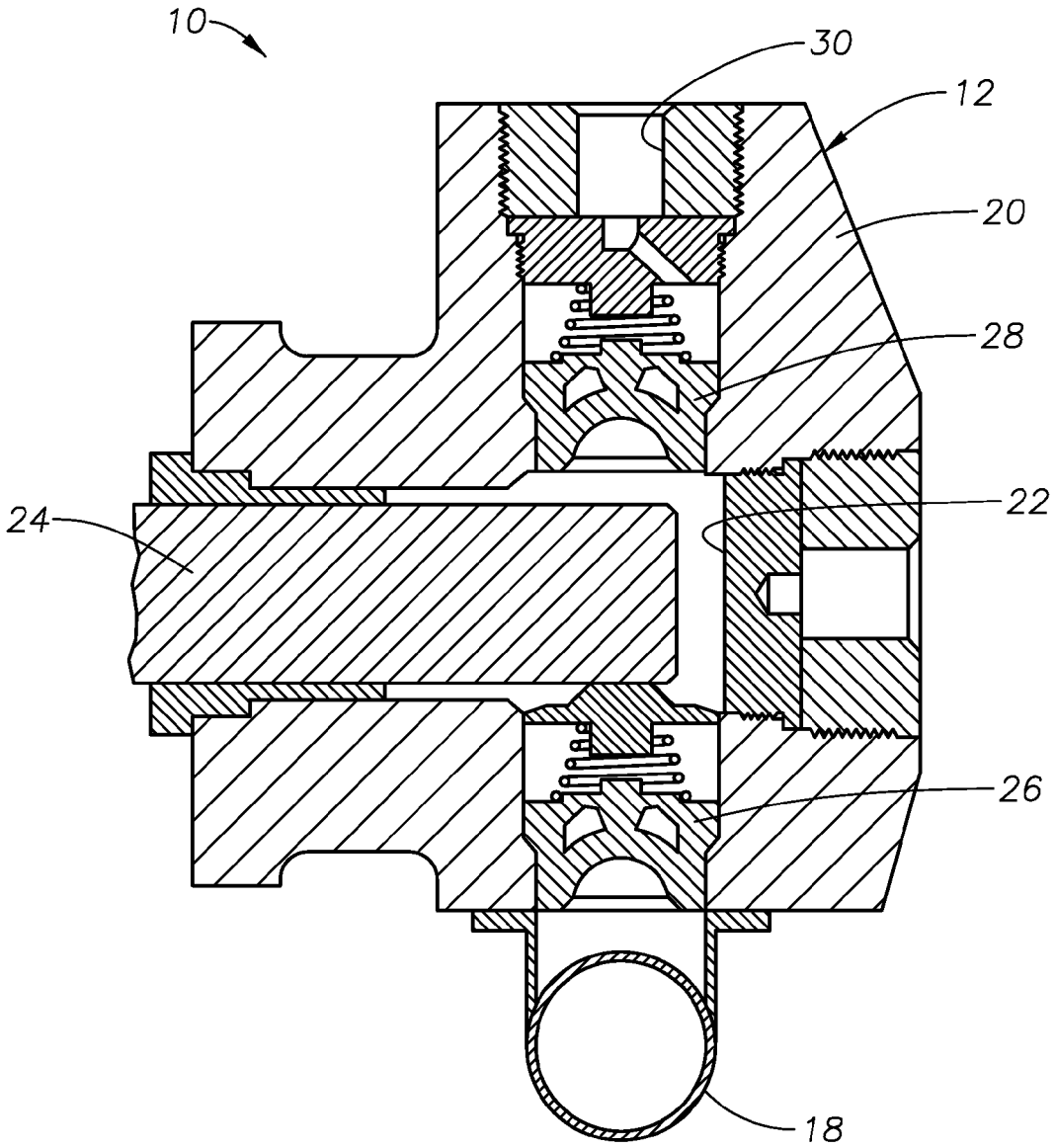
FIG. 3 is a cross-sectional view of the fluid end of the pump.
Figure 4:
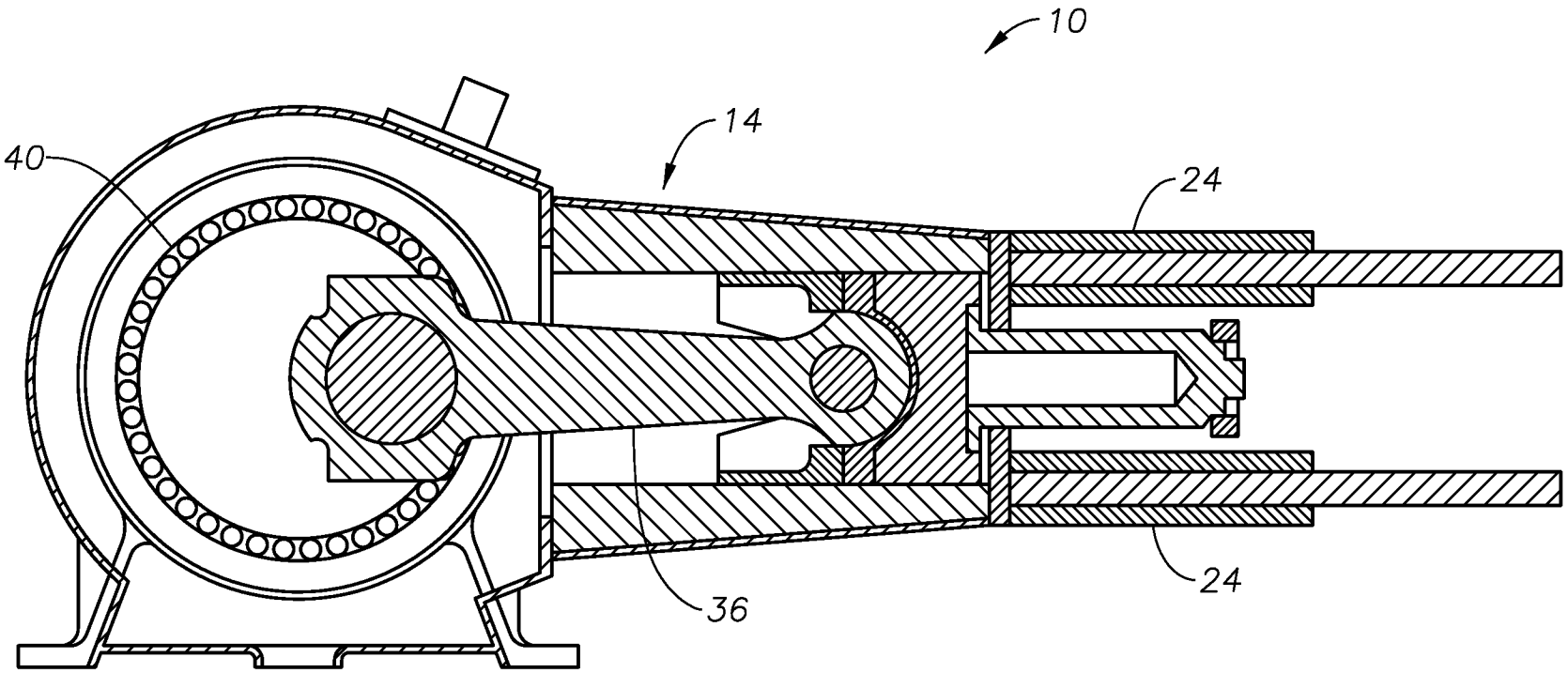
FIG. 4 is a cross-sectional view of portions of the power end of the pump.

The cross-sectional view of FIG. 3 illustrates a cylinder housing 20 for the fluid end 12 which encloses a valve piston chamber 22 within which a plunger 24 is axially moveable in a reciprocating manner, as driven by a crankshaft. Although only a single plunger 24 is visible in FIG. 3, it should be understood that there are actually three plungers 24 within the housing 20. This reciprocating movement causes an intake valve 26 and an exhaust valve 28 to be opened and closed as fluid is pumped from the suction manifold 18 to the discharge 30.

The general construction and operation of reciprocating pumps is well understood and will not be detailed here. It is noted, however, that the plunger(s) 24 is/are driven by the power end 14, depicted in FIG. 4, which includes a crankshaft 36 and axially moveable plungers 24 which are driven by a drive train 40. Each full rotational cycle of the crankshaft 36 is considered to be a revolution of the pump 10. The suction manifold 18 is constantly fed with the fluid medium to be pumped. A minimum level of energy should be constantly kept inside the suction manifold 18, which is normally accomplished by maintaining a sufficient minimum flow rate and supply pressure.

Figure 5:
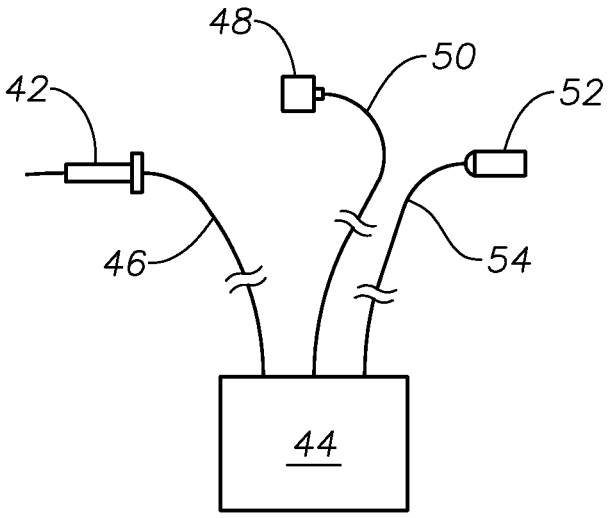
FIG. 5 is a schematic diagram of portions of an exemplary pump monitoring system which includes a data processor and associated components.
Figure 6:
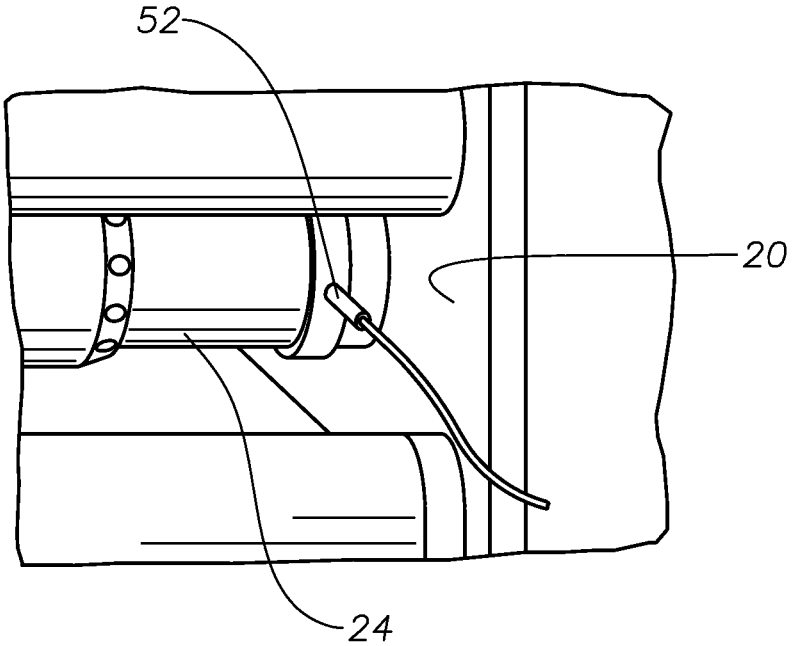
FIG. 6 is an enlarged external, isometric view of portions of the reciprocating pump shown in FIGS. 1-4.

A pressure transducer 42 (FIGS. 1-2) is operably associated with the suction manifold 18. The pressure transducer 42 is also operably associated with a data processor 44 via transmission medium 46. It is noted that, while transmission medium 46 is depicted as being an electrical cable, wireless transmission, of types known in the art, could also be used. The pressure transducer 42 is adapted to detect fluid pressure within the suction manifold 18 and transmit a signal representative of the detected pressure to the data processor 44. FIG. 5 is a schematic illustration of portions of a pump monitoring system in accordance with the present invention which includes a data processor 44 and pressure transducer 42.

Figure 2:
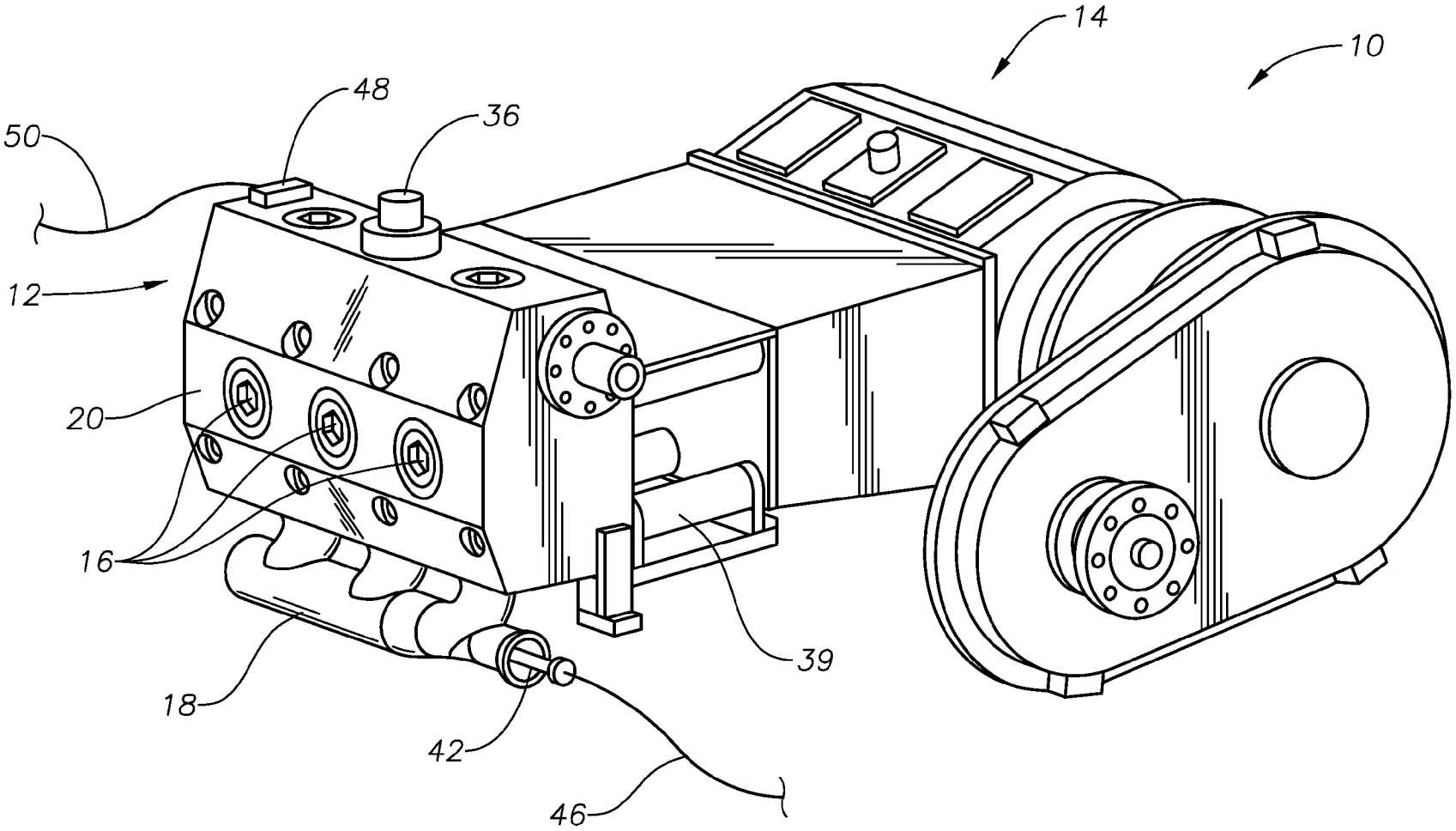
FIG. 2 is a further external, isometric view of the pump shown in FIG. 1.

An accelerometer 48 is mounted upon or otherwise operably associated with the fluid end cylinder housing 20, as illustrated in FIGS. 1-2. The accelerometer 48 is preferably a three-axis accelerometer and is designed to measure vibration of the cylinder housing 20 and provide a signal representative of detected vibration via transmission medium 50 to the data processor 44.

A timing marker 52 is operably associated with plunger 24. If there are multiple plungers 24, only a single plunger need have a timing marker 52. The timing marker 52 is operable to provide an indication of the speed of operation of the pump 10 by detecting movement of the plunger 24. This speed measurement is transmitted to the data processor 44 via transmission medium 54. In accordance with an alternative embodiment, the speed of the pump 10 is obtained by a rotational pick-up sensor (not shown), of a type known in the art, at the power end 14 of the pump 10.

The data processor 44 is programmed to receive data from each of the pressure sensor 42, accelerometer 48 and the timing marker 52 (or rotational pick up sensor). In particular embodiments, the processor 44 compares the fluid pressure detected by the pressure transducer 42 with a preprogrammed pressure which corresponds to the vapor pressure of the fluid being pumped by the pump 10. When the detected fluid pressure approximates the vapor pressure, this condition is conducive to cavitation. In accordance with preferred embodiments, the processor 44 correlates the presence of a detected-pressure-approximating-vapor-pressure condition with an increase in vibration, as detected by the accelerometer 48. A correlation of these two conditions will indicate the presence of cavitation in the pump 10. In addition, the inventors have determined that such a correlation in increased vibration indicates cavitation to the exclusion of other abnormal pump conditions. Pressure and vibration per revolution (as measured by the timing marker 52) is done to detect cavitation. Preferably, the sensors provide measurements on a continuous basis, and the speed measurement provided by the timing marker 52 allows the continuous signals to be divided on a per revolution basis.

Figure 7:
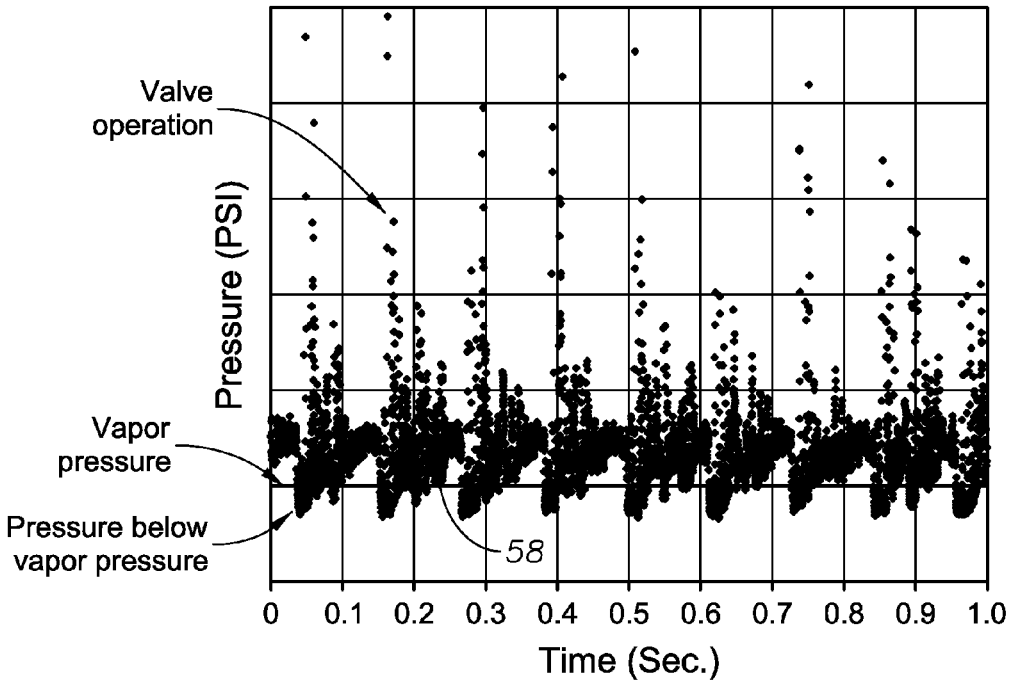
FIG. 7 is a data plot depicting fluid pressure measurements for the suction manifold during pump operation.
Figure 8:
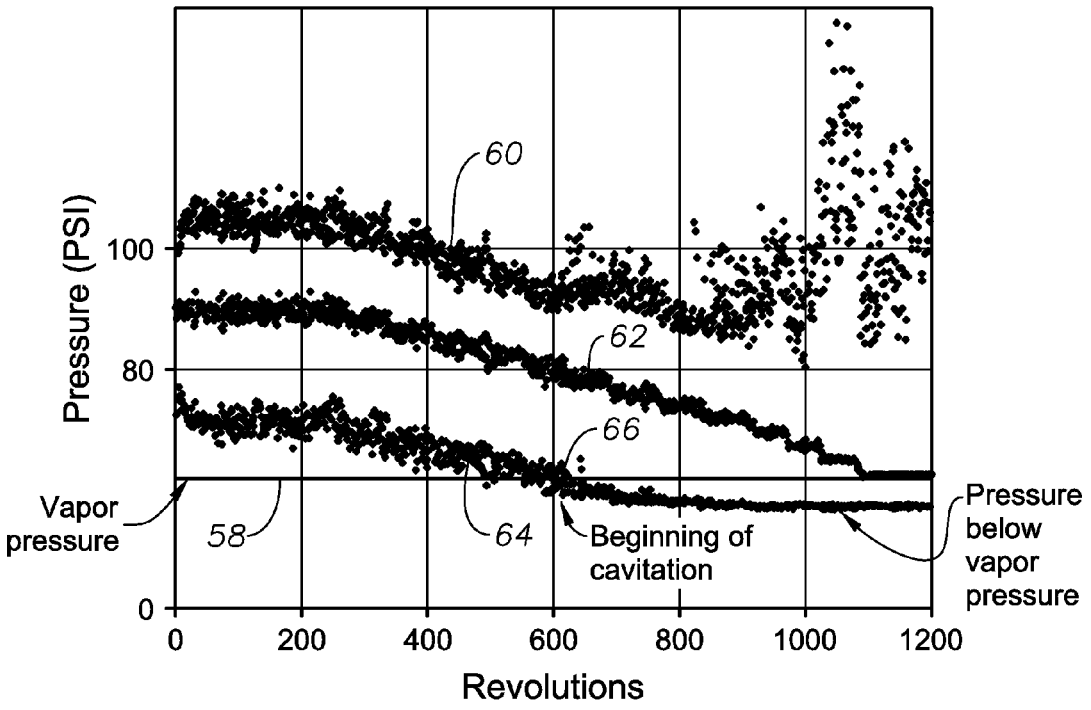
FIG. 8 is a data plot of transformed suction pressure data showing the beginning of cavitation.
Figure 9:
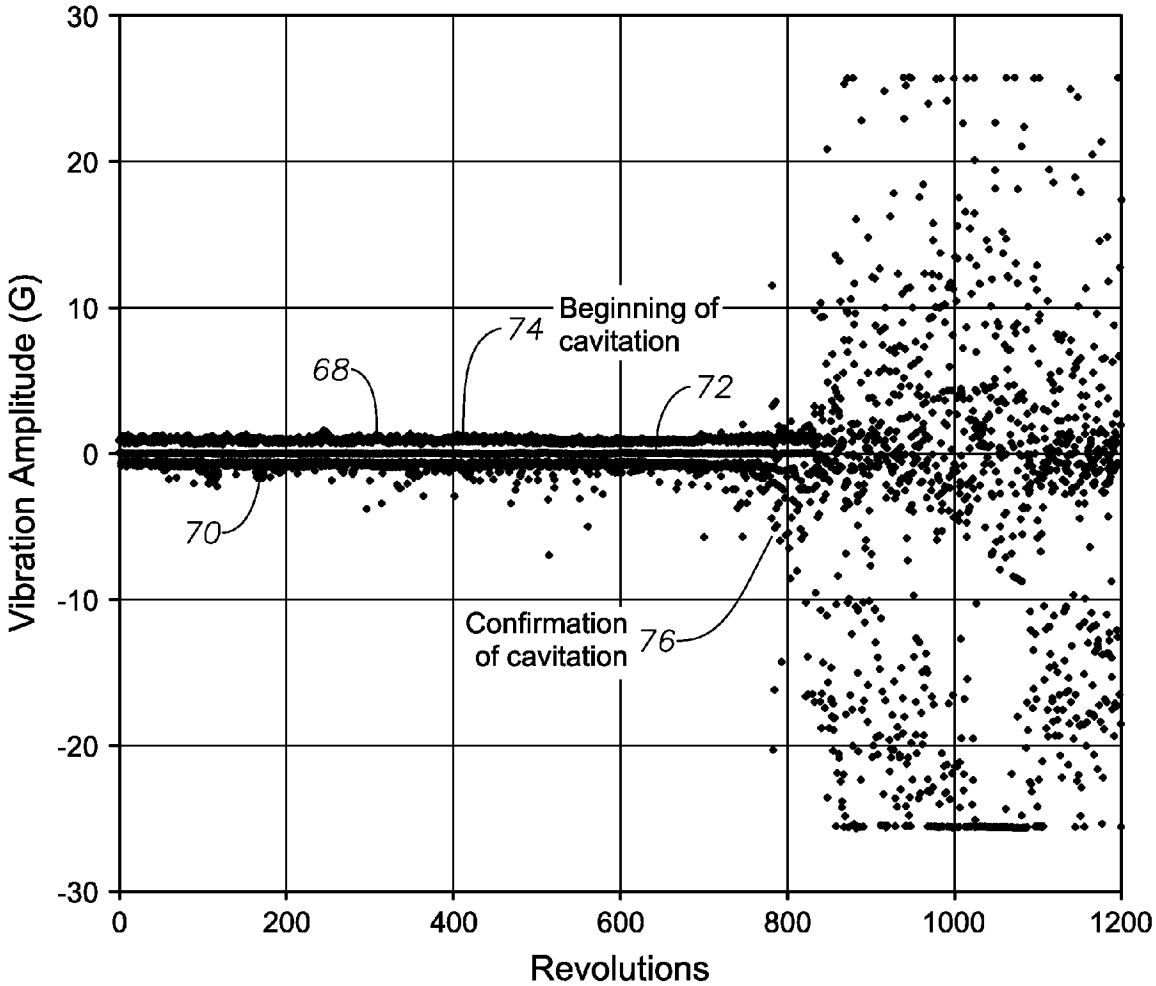
FIG. 9 is a data plot of detected pump vibration.

FIGS. 7-9 depict exemplary data measurements which might be obtained by a pump monitoring system in accordance with the present invention and illustrates detection of cavitation in a pump. FIG. 7 is a data plot showing suction pressure within the manifold 18 as detected by the pressure sensor 42. It can be seen that the detected pressure rises and falls over time as the intake valve 26 opens and closes. In the depicted plot, the vapor pressure of the fluid being pumped by the pump is represented by the line 58. Data plot points below the line 58 are indicative of the detected pressure being below vapor pressure while those points above the line 58 are above vapor pressure. FIG. 8 depicts transformed suction pressure data, with detected pressure being plotted against pump revolutions. Plot points 60 represent maximum pressure readings during each revolution of the pump 10. Plot points 62 are average pressure readings per revolution while plot points 64 are minimum pressure reading per revolution. It is possible to detect when minimum suction pressure 64 is below vapor pressure consistently (more than 25 cycles). Point 66 represents a point where detected fluid pressure at the manifold 18 approximates vapor pressure 58 and is therefore a suspected point for the beginning of cavitation.

FIG. 9 is a data plot which depicts pump vibration amplitude, as measured by the accelerometer 48, against pump revolutions. The upper group of data points 68 represents vibration ("G"s) in a positive direction while the lower group of points 70 represent vibration in a negative direction. Points 72 lie closest to the zero axis and represent average vibration. It can be seen from FIG. 9 that the accelerometer 48 begins to detect vibrations resulting from cavitation at or slightly after the time when pressure in the suction manifold 18 reaches vapor pressure (point 74 in FIG. 9). FIG. 9 shows that it takes a few seconds (approximately 200 revolutions) for cavitation to cause significant vibration, which can be seen starting at about point 76.

Figure 10:
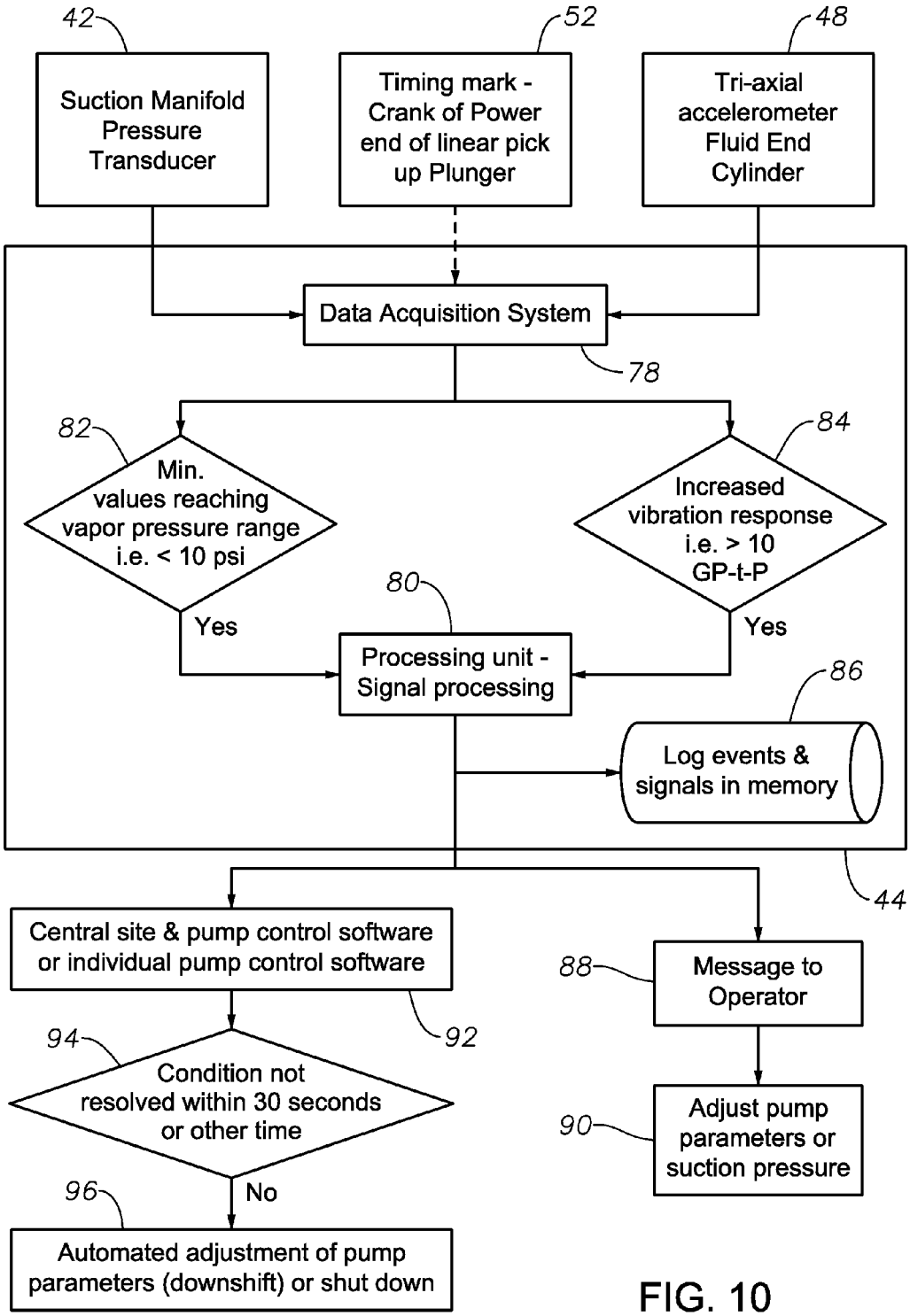
FIG. 10 is a logic diagram for an exemplary pump monitoring system.

FIG. 10 is an exemplary logic diagram which depicts illustrative data measurement, acquisition and processing by an exemplary pump monitoring system. A data acquisition system 78 obtains measured parameters from the suction manifold pressure sensor 42, accelerometer 48 and timing marker 52. It is noted that the data acquisition system 78 may be contained within the general processor 44. A processing unit 80, which may be a programmable logic controller, then determines whether the minimum detected suction pressure (i.e., points 64) have reached or approximate vapor pressure 58. This occurs in step 82 in FIG. 10. The processing unit 80 also determines (step 84) whether there is increased vibration, as detected by the accelerometer 48 at or shortly after. If so, the processing unit 80 logs the event and signals in memory at step 86.

Optionally, the processing unit 80 is programmed to perform one or more operations that comprise corrective actions to try to cure the cavitation problem. The processing unit 80 can send a message to an operator (step 88) in the form of a visual or audible alarm, an electronic message or the like. This will allow the operator to adjust the pump parameters or suction pressure (step 90) to compensate for or correct the cavitation condition. Also optionally, the processing unit 80 might execute, or cause to be executed, central site and pump control software or individual pump control software (step 92). If the processing unit 80 then determines (step 94) that the cavitation condition is not resolved within a particular amount of time, such as 30 seconds, pump parameters are adjusted by the software (step 96) or the pump is shut down.

In accordance with the present invention, pump monitoring devices may be constructed which can be affixed to or located alongside a pump. These monitoring devices would include a processor 44 and the associated sensor components 42, 48, 52.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A system for detecting cavitation within a positive displacement pump, the system comprising:

a pressure sensor to detect fluid pressure at a location within the pump;

an accelerometer to detect vibration in the pump; and a processor operably associated with the pressure sensor and accelerometer to:

compare detected fluid pressure with a predetermined pressure to determine when detected fluid pressure approximates the predetermined pressure; and correlate detected fluid pressure with vibration when said detected fluid pressure approximates predetermined pressure to confirm the presence of cavitation.

2. The system of claim 1 wherein the pressure sensor is located to detect fluid pressure proximate a suction manifold of the pump.

3. The system of claim 1 wherein the predetermined pressure is vapor pressure for a fluid being pumped by the pump.

4. The system of claim 1 further comprising a timing marker to measure pump speed.

5. The system of claim 4 wherein the processor further correlates the detected fluid pressure and vibration with measured pump speed.

6. A system for detecting cavitation within a positive displacement pump, the system comprising:

a pressure sensor to detect fluid pressure proximate a suction manifold of the pump;

an accelerometer to detect vibration in the pump; and a processor operably associated with the pressure sensor and accelerometer to:

compare detected fluid pressure with a predetermined pressure to determine when detected fluid pressure approximates the predetermined pressure; and correlate detected fluid pressure with vibration when said detected fluid pressure approximates predetermined pressure to confirm the presence of cavitation.

7. The system of claim 6 wherein the predetermined pressure is vapor pressure for a fluid being pumped by the pump.

8. The system of claim 6 further comprising a timing marker to measure pump speed.

9. The system of claim 8 wherein the processor further correlates the detected fluid pressure and vibration with measured pump speed.

10. A method of detecting cavitation within a positive displacement pump, the method comprising the steps of:

detecting fluid pressure within the pump;

detecting vibration of the pump during operation of the pump;

comparing the detected fluid pressure with a predetermined pressure that is conducive to cavitation to determine whether the detected fluid pressure approximates the predetermined pressure;

if detected pressure approximates the predetermined pressure, correlate the detected pressure with vibration to confirm the presence of cavitation.

11. The method of claim 10 wherein the predetermined pressure is vapor pressure for a fluid being pumped by the pump.

12. The method of claim 10 wherein fluid pressure is detected by a pressure sensor proximate a suction manifold of the pump.

13. The method of claim 10 wherein the step of comparing the detected fluid pressure with a predetermined pressure is performed by a processor.

14. The method of claim 10 wherein the step of correlating the detected pressure with vibration further comprises dividing the detected pressure and vibration per revolution of the pump.

15. The method of claim 10 further comprising the step of performing corrective action for corrected cavitation.

* * * * *